US008109804B2

(12) United States Patent
Su

(10) Patent No.: US 8,109,804 B2
(45) Date of Patent: Feb. 7, 2012

(54) CRAWLING DEVICE

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 538 days.

(21) Appl. No.: 12/428,482

(22) Filed: Apr. 23, 2009

(65) Prior Publication Data

US 2010/0093253 A1 Apr. 15, 2010

(30) Foreign Application Priority Data

Oct. 14, 2008 (CN) ..... 2008 1 0304920

(51) Int. Cl.
*A63H 33/26* (2006.01)

(52) U.S. Cl. ..... 446/131; 446/330; 446/129; 267/166

(58) Field of Classification Search ..... 446/129–139, 446/484; D21/404; 191/10; 335/235, 229–234, 335/220; 72/54; *A63H 33/26*
See application file for complete search history.

(56) References Cited

U.S. PATENT DOCUMENTS

| | | | | |
|---|---|---|---|---|
| 3,490,172 | A * | 1/1970 | Schwartz | 446/298 |
| 4,319,427 | A * | 3/1982 | Way, Jr. | 446/138 |
| 5,692,737 | A * | 12/1997 | Perlsweig | 267/168 |
| 6,000,991 | A * | 12/1999 | Truchsess et al. | 446/397 |
| 2005/0001367 | A1 * | 1/2005 | Taya et al. | 267/166 |
| 2006/0044093 | A1 * | 3/2006 | Ohta et al. | 335/220 |
| 2007/0236314 | A1 * | 10/2007 | Taya et al. | 335/220 |

* cited by examiner

*Primary Examiner* — Gene Kim
*Assistant Examiner* — Matthew B Stanczak
(74) *Attorney, Agent, or Firm* — Altis Law Group, Inc.

(57) ABSTRACT

A crawling device includes a first end with a first magnet recessed therein, a second end with a second magnet recessed therein, an elastic member disposed between the first end and the second end, a power source module, and a controller. When the first and second ends are supported on a supporting surface, and the controller connects the power source module to the first end and the elastic member, the first magnet extends beyond the first end onto the supporting surface and the elastic member becomes compressed toward the first end. When the elastic member is compressed, and the controller connects the power source module to the second end, the second magnet extends beyond the second end onto the supporting surface and the elastic member returns to the normal state.

12 Claims, 5 Drawing Sheets

CRAWLING DEVICE

BACKGROUND

1. Technical Field

The disclosure relates to crawling devices, and particularly, to a crawling device used in a toy.

2. Description of the Related Art

Some animal shaped toys lack any moveable parts, other animal shaped toys provide limited movement such as rotation of a limb about a corresponding joint. However the motion of these toys is not verisimilar to that of the actual animals, so it is easy for children to lose interest in these toys.

Accordingly, it is desirable to provide a crawling device used in a toy, which can overcome the above-mentioned problem.

DETAILED DESCRIPTION

Embodiments of the disclosure will now be described in detail with reference to the accompanying drawings.

Figure 1:
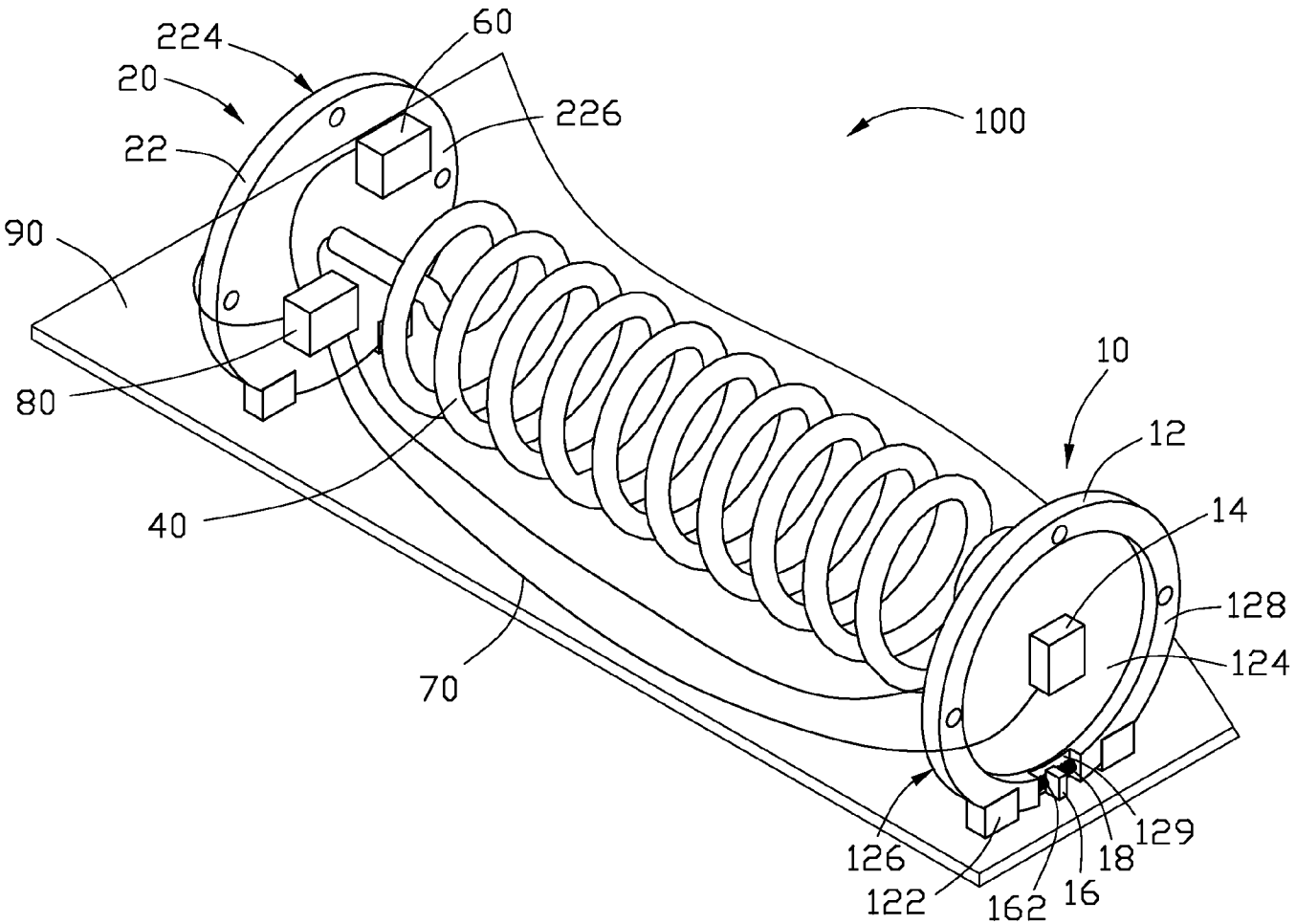
FIG. 1 is a schematic isometric view of a crawling device having a first end and an elastic member according to an exemplary embodiment.
Figure 2:
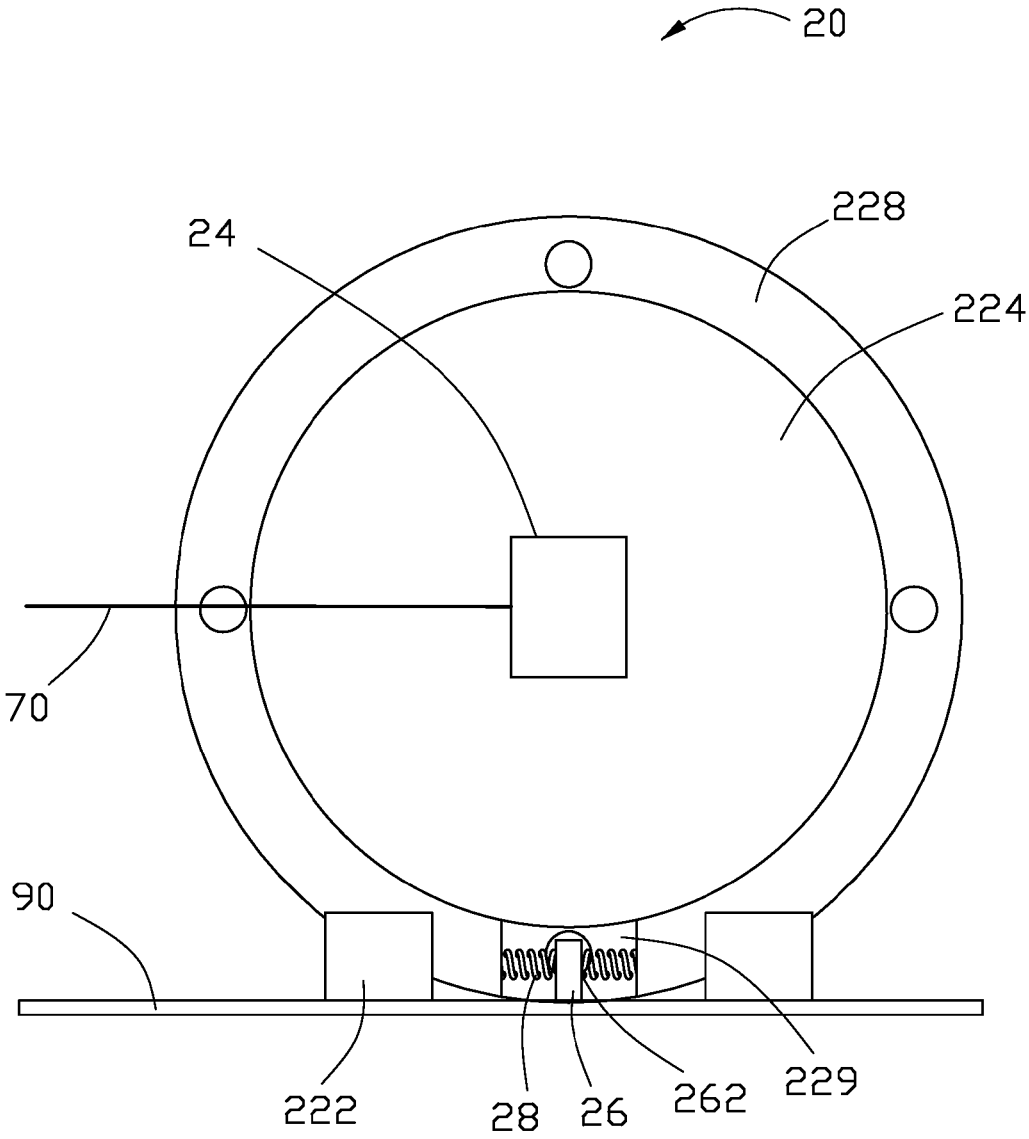
FIG. 2 is a schematic isometric view of the second end of the crawling device of FIG 1.

Referring to FIGS. 1-2, a crawling device 100 according to an exemplary embodiment is shown. The crawling device 100 includes a first end 10, a second end 20, an elastic member 40, a power source module 60 and a controller 80. The elastic member 40 is disposed between the first end 10 and the second end 20. In the embodiment, the elastic member 40 is a spring. The controller 80 is configured for electrically connecting the power source module 60 to the first end 10, the second end 20, and the elastic member 40 by wires 70.

The first end 10 includes a first main body 12, a first electromagnet 14, a first magnet 16, and a first spring 18. In the embodiment, the first main body 12 is substantially circular. The first main body 12 includes a first supporting portion 122, a first surface 124, and a second surface 126 opposite to the first surface 124. The first supporting portion 122 is configured for supporting the first main body 12 on a supporting surface 90, such as a top of a table or on the ground. In the embodiment, the supporting surface 90 is the ground. The first electromagnet 14 is mounted on the first surface 124 and electrically connected to the controller 80. In this embodiment, the first electromagnet 14 is glued to the first surface 124. The first spring 18 is mounted on the first surface 124 near the first supporting portion 122, and the first magnet 16 is mounted on the first spring 18, thereby following a movement of the first spring 18. In the embodiment, the first magnet 16 defines a first through hole 162, and the first spring 18 is inserted through the first through hole 162 and mounted on the first main body 12. In the embodiment, a first flange 128 extends from the first surface 124 of the first main body 12, a first cutout 129 is defined in the first flange 128, and two ends of the first spring 18 are correspondingly mounted between the two ends of the first flange 128 in the first cutout 129.

When the controller 80 connects the power source module 60 to the first electromagnet 14, the first electromagnet 14 becomes magnetized and repels the first magnet 16 away, supporting on the supporting surface 90. When the controller 80 disconnects the power source module 60 to the first electromagnet 14, the first electromagnet 14 is no longer magnetized and the first magnet 16 returns to its original position.

The second end 20 includes a second main body 22, a second electromagnet 24, a second magnet 26 and a second spring 28. The second main body 22 is substantially circular. The second main body 22 includes a second supporting portion 222, a first surface 224 and a second surface 226 opposite to the first surface 224. The second supporting portion 222 is configured for supporting the second main body 22 on the supporting surface 90. The second electromagnet 24 is mounted on the first surface 224 and electrically connected to the controller 80. In this embodiment, the second electromagnet 24 is glued to the second surface 226. The second spring 28 is mounted on the first surface 224 near the second supporting portion 222, and the second magnet 26 is mounted on the second spring 28, thereby following a movement of the second spring 28. In the embodiment, the second magnet 26 defines a second through hole 262, and the second spring 28 is inserted through the second through hole 262 and mounted on the second main body 22. In the embodiment, a second flange 228 extends from the first surface 224 of the second main body 22, a second cutout 229 is defined in the second flange 228, and two ends of the second spring 28 are correspondingly mounted between the two ends of the second flange 228 in the second cutout 229.

When the controller 80 connects the power source module 60 to the second electromagnet 24, the second electromagnet 24 repels the second magnet 26 away, supporting on the supporting surface 90. When the controller 80 disconnects the power source module 60 to the second electromagnet 24, the second electromagnet 24 is no longer magnetized and the second magnet 26 returns to its original position.

Two ends of the elastic member 40 are mounted between the second surface 126 of the first main body 12 and the second surface 226 of the second main body 22. When the controller 80 disconnects the power source module 60 to the elastic member 40, the length of the elastic member 40 substantially equals to the distance between the first end 10 and second end 20. That is to say, the elastic member 40 is in normal state when the power source is not applied. When the power source is applied on the elastic member 40 by the controller 80, the elastic member 40 becomes compressed. When the power source is cut off the elastic member 40 by the controller 80, the elastic member 40 is in a free state.

The power source module 60 is mounted on the second surface 226 of the second end 20. In the embodiment, the power source module 60 is a battery, such as a rechargeable battery or a dry battery.

The controller 80 is mounted on the second surface 226 of the second end 20 and configured for controlling a connection between the power source module 60 to the first electromagnet 14, the second electromagnet 24, and the elastic member 40 according to a state of the elastic member 40. In the embodiment, when the elastic member 40 is in the normal state, the controller 80 connects the power source module 60 to the second end 20 and the elastic member 40. When the elastic member 40 is compressed to a first compressed limit, the controller 80 disconnects the power source module 60 to the second end 20 and the elastic member 40 and connects the power source module 60 to the first end 10. It is to be understood, the controller 80 can connect and disconnect the power source module 60 with the first electromagnet 14, the second electromagnet 24 and the elastic member 40 according to predetermined sequences.

Figure 3:
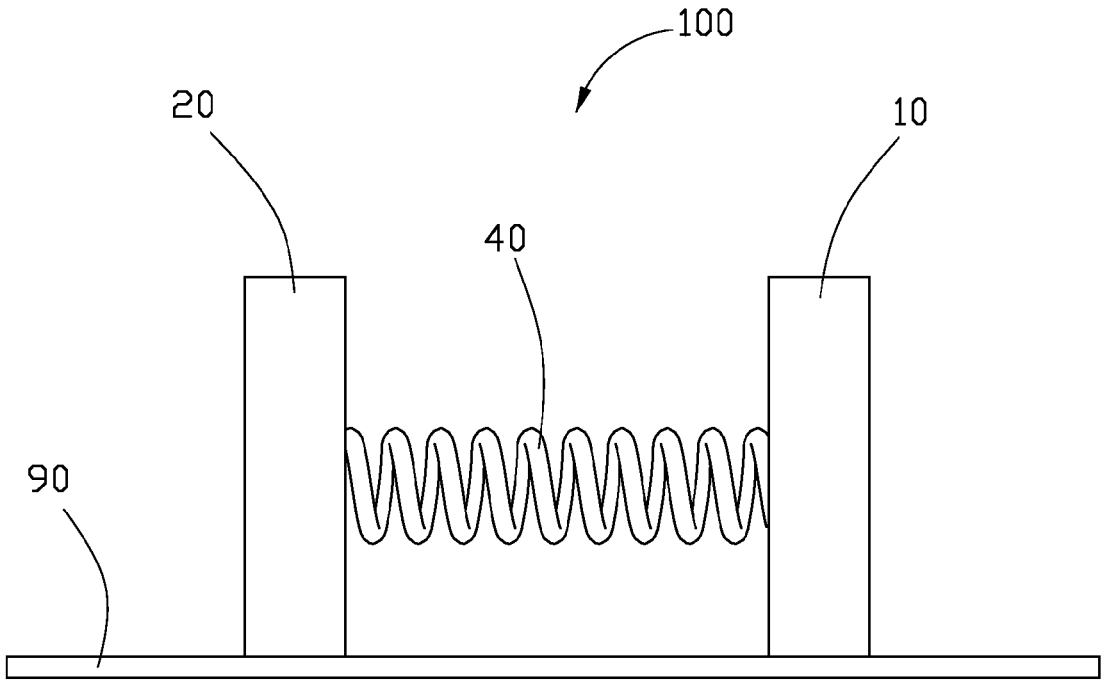
FIG. 3 is a side view of a normal state of the elastic member of FIG. 1.
Figure 4:
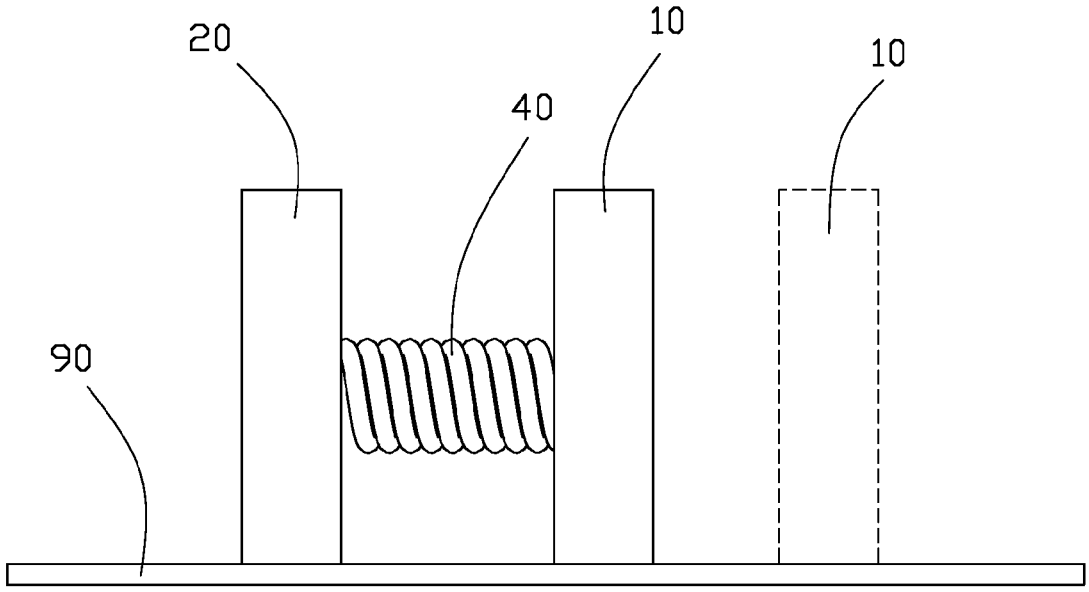
FIG. 4 is similar to FIG. 3, but showing a compressed state of the elastic member of FIG. 1.

Referring to FIG. 3, the crawling device 100 is on the supporting surface 90, and the elastic member 40 is in the normal state. The controller 80 connects the power source module 60 to the second electromagnet 24 and the elastic member 40, as a result, the second electromagnet 24 repels the second magnet 26 to extend out of the second cutout 229, beyond the second supporting portion 222, and supports on the supporting surface 90; the first electromagnet 14 is no longer magnetized and the first magnet 16 returns to its original position, disengaging with the supporting surface 90; and the elastic member 40 compresses. Because the second magnet 26 of the second end 20 and the second supporting portion 222 support on the supporting surface 90, the first supporting portion 122 of the first end 10 moves toward the second end 20 (see FIG. 4) under the compression force of the elastic member 40.

Figure 5:
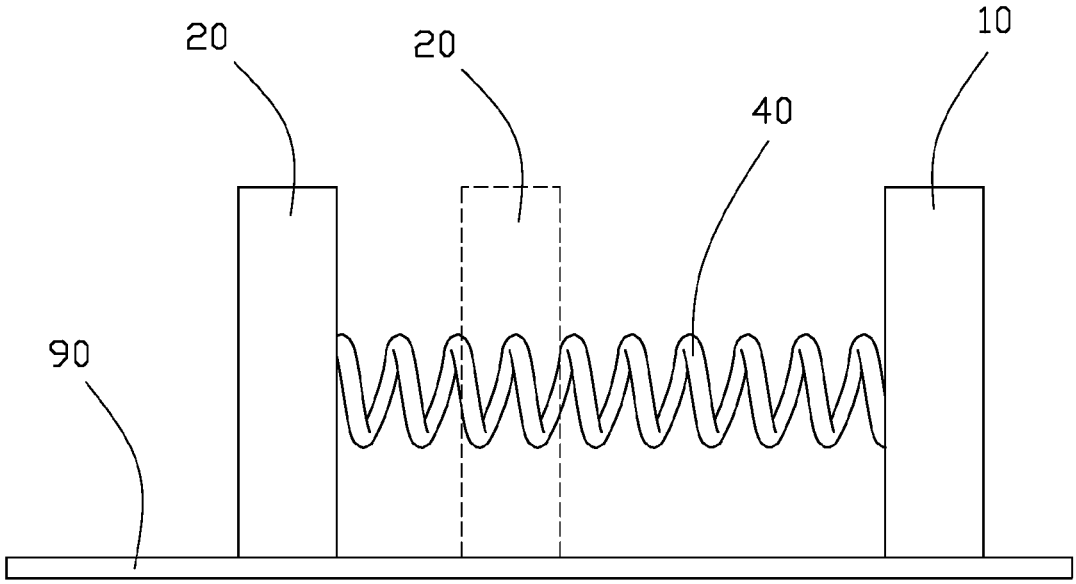
FIG. 5 is similar to FIG. 4, but showing an elongated state of the elastic member of FIG. 1.

Referring to FIG. 5, in the embodiment, when the elastic member 40 is compressed to the first compressed limit, the controller 80 disconnects the power source module 60 to the second electromagnet 24 and the elastic member 40 and the controller 80 connects the power source module 60 to the first electromagnet 14, the first electromagnet 14 repels the first magnet 16 to extend out of the first cutout 129, beyond the first supporting portion 122, and support on the supporting surface 90; the second electromagnet 24 is no longer magnetized and the second magnet 26 returns to its original position, disengaging with the supporting surface 90; and the elastic member 40 expands or returns to the normal state and the second end 20 moves away from the first end 10.

The crawling device 100 can move when the power source module 60 provides the power source to the first electromagnet 14, the second electromagnet 24, and the elastic member 40 by the controller 80. When the crawling device 100 is used in an animated toy, such as a toy imitating a worm toy, the crawling device 100 will retain the interest of users of the toy.

It is to be understood, however, that even though numerous characteristics and advantages of the embodiments have been set forth in the foregoing description, together with details of the structures and functions of the embodiments, the disclosure is illustrative only, and changes may be made in detail, especially in matters of arrangement of parts within the principles of the invention to the full extent indicated by the broad general meaning of the terms in which the appended claims are expressed.

What is claimed is:

1. A crawling device comprising:

a first end with a first magnet recessed therein;

a second end with a second magnet recessed therein;

an elastic member disposed between the first end and the second end;

a power source module; and a controller configured for connecting the power source module to the first end, the second end and the elastic member according to a state of the elastic member;

wherein when the first end and the second end are supported on a supporting surface, the controller connects the power source module to the first end and the elastic member, the first magnet extends beyond the first end and is supported on the supporting surface and the elastic member becomes compressed toward the first end;

when the elastic member is compressed, and the controller connects the power source module to the second end, the second magnet extends beyond the second end and is supported on the supporting surface and the elastic member returns to the normal state.

2. The crawling device of claim 1, wherein the first end comprises a first main body, a first electromagnet mounted on the first main body and electrically connected to the controller and a first spring mounted on the first main body, the first magnet being mounted on the first spring.

3. The crawling device of claim 2, wherein the first main body comprises a first supporting portion and a first surface, the first electromagnet being mounted on the first surface, the first spring being mounted on the first surface of the first main body near the first supporting portion.

4. The crawling device of claim 3, wherein the first main body further comprises a first flange extending from the first surface of the first body and defining a first cutout, the first spring being mounted between two ends of the first flange in the first cutout.

5. The crawling device of claim 2, wherein the first electromagnet is glued to the first surface of the first main body.

6. The crawling device of claim 2, wherein the first magnet defines a first through hole corresponding to the first spring, the first spring being inserted through the first through hole and mounted on the first main body.

7. The crawling device of claim 1, wherein the elastic member is a spring.

8. The crawling device of claim 1, wherein the second end comprises a second main body, a second electromagnet mounted on the second main body and electrically connected to the controller and a second spring mounted on the second main body, the second magnet being mounted on the second spring.

9. The crawling device of claim 8, wherein the second main body further comprises a second supporting portion and a first surface, the second electromagnet being mounted on the first surface of the second main body, the second spring being mounted on the first surface of the second main body near the second supporting portion.

10. The crawling device of claim 9, wherein the second main body comprises a second flange extending from the first surface of the second main body and defining a second cutout, the second spring being mounted between two ends of the second flange in the second cutout.

11. The crawling device of claim 8, wherein the second main body comprises a second surface opposite to the first surface of the second main body, and the second electromagnet is glued to second surface of the second main body.

12. The crawling device of claim 8, wherein the second magnet defines a second through hole corresponding to the second spring, the second spring being inserted through the second hole and mounted on the second main body.

* * * * *